US007748171B2

(12) United States Patent
Barnett

(10) Patent No.: US 7,748,171 B2
(45) Date of Patent: Jul. 6, 2010

(54) WATER AND DEBRIS SEPARATOR FOR GUTTERS

(76) Inventor: O. Lynn Barnett, 1300 Maple Grove Cir., Clinton, OH (US) 44216

( * ) Notice: Subject to any disclaimer, the term of this patent is extended or adjusted under 35 U.S.C. 154(b) by 0 days.

(21) Appl. No.: 12/467,273

(22) Filed: May 16, 2009

(65) Prior Publication Data

US 2009/0223137 A1 Sep. 10, 2009

Related U.S. Application Data

(62) Division of application No. 11/243,586, filed on Oct. 5, 2005, now abandoned.

(60) Provisional application No. 60/616,303, filed on Oct. 5, 2004.

(51) Int. Cl.
*E04D 13/00* (2006.01)

(52) U.S. Cl. ..... 52/12

(58) Field of Classification Search ..... 52/11, 52/12; 428/597; 72/379.6; 29/896.6
See application file for complete search history.

(56) References Cited

U.S. PATENT DOCUMENTS 3,387,422 A * 6/1968 Wanzer ..... 52/387
4,411,110 A * 10/1983 Carey ..... 52/11
4,615,153 A * 10/1986 Carey ..... 52/12
4,631,875 A * 12/1986 Olson ..... 52/12
5,099,620 A * 3/1992 Carey ..... 52/12
2004/0255522 A1* 12/2004 Knudson et al. ..... 52/11
2005/0274082 A1* 12/2005 Welty ..... 52/120

* cited by examiner

*Primary Examiner*—Brian E Glessner
*Assistant Examiner*—Adriana Figueroa
(74) *Attorney, Agent, or Firm*—DA Stauffer Patent Services LLC

(57) ABSTRACT

A gutter shield for separating debris from water entering a gutter, the shield being intended for installation over a conventional longitudinally extending gutter that is mounted outboard from and below a longitudinally extending roof edge. The gutter shield includes a longitudinally extending length of planar stock material that is perforated by a plurality of intermittent, longitudinally extending slots, each slot being at the outboard edge of a tab that ramps downward and outward from a top surface of the stock material; and a longitudinally extending ridge extending downward from an underside of the shield for the purpose of breaking up water sheeting along the underside of the shield. The tab is elongated in ways that discourage sheeting while encouraging flow rate by entraining. Capillary action in opposition to water sheeting on the top surface of the shield is encouraging by gradually and smoothly curving the bend at an inboard bent edge of the tab.

14 Claims, 3 Drawing Sheets

WATER AND DEBRIS SEPARATOR FOR GUTTERS

CROSS-REFERENCE TO RELATED APPLICATIONS

This application is a divisional application continuing from the co-pending utility patent application Ser. No. 11/243,586 filed on Oct. 5, 2005, which in turn claims the benefit of U.S. Provisional Patent Application No. 60/616,303, filed Oct. 5, 2004, the entirety of which is incorporated by reference herein. All of the above applications are filed by the inventor O. Lynn Barnett.

This application incorporates amendments to the description and drawings that were entered in the parent application through amendment letter filed Sep. 18, 2007. Said amendments do not constitute new material.

Claims that were withdrawn in the parent application are pursued, in amended form, in the present application.

TECHNICAL FIELD OF THE INVENTION

The present invention relates to strainers for eave troughs on static structure covers and, more particularly, to a straining means (gutter shield) for preventing debris from entering rain gutters at the edges of building roofs.

BACKGROUND OF THE INVENTION

It is well known that open trough roof gutters fill with leaves and other debris causing impaired effectiveness of the gutter as a roof drainage system. Frequently, water accumulates in clogged gutters causing an overflow failure which can damage the building. If the gutters freeze, the expanding water can deform the gutter and may cause it to pull away from the building support. The water may also force its way back up under the shingles or roof covering, causing damage to the roof itself. Thus some form of gutter shield is desirable for separating (straining) debris from the water running off of a roof edge. Ideally, such a shield will not only allow, but encourage water to flow into the gutter while debris is separated and enabled to slide off the outer edge of the shielded gutter.

Some known gutter shields are formed of screen material (e.g., hardware cloth), or expanded metal screening in which a web of metal stock is slit and then drawn or expanded so as to laterally stretch open the slits to form openings for water and yet at the same time to shield the gutter from debris. Such systems, while somewhat effective in guarding against accumulation of larger debris (e.g., twigs and leaves) in the gutters, they have openings which are large enough to allow smaller items of debris (e.g., small seeds, "propeller" vanes on seed pods, evergreen "needles" and leaf fragments) to pass through either partly or entirely. If not removed, these materials accumulate and eventually clog the shield and/or the gutter.

Prior art gutter shields that, like the above-described screening, have a rather rough surface texture can become externally clogged because such arrangements allow debris to accumulate on the shield itself thereby blocking water's access to the gutter and rendering it ineffective. In such cases, water can well up about the accumulated debris and migrate under the edge of the roof and/or roof covering causing damage.

U.S. Pat. No. 6,073,398 (Williams; 2000) discloses a gutter cover with a planar back area (14) connected to a curved front portion (18) that leads water by capillary action into the covered gutter. It can be seen that debris (at least larger pieces) generally will not follow the curved portion and will instead wash off the outside edge of the covered gutter. Other examples of capillary action shields with gutter access holes beyond a curved portion include U.S. Pat. No. 5,251,410 (Carey; 1993) and U.S. Pat. No. 4,616,450 (Shouse; 1986).

A problem with designs such as Williams '398, Carey '410, and Shouse '450 is that in a hard rain, water flow is too great and a significant portion of the water will simply shoot outward beyond the outside edge of the covered gutter. In order to address this problem, gutter shields such as those disclosed in U.S. Pat. No. 5,640,809 (Iannelli; 1997) and U.S. Pat. No. 5,557,891 (Albracht; 1996) provide means for slowing down the flow of water. Iannelli '809 provides a substantially planar primary surface (20) that has longitudinal protuberances (35) and a rise (36); and Albracht '891 has a relatively wide horizontal portion (7).

There are also problems with gutter shields that are secured horizontally across the top opening of the gutter, or which have substantially planar or wide horizontal portions. Since debris may not be washed off of such horizontal portions, the weight of accumulated debris on the gutter, which bears the weight of the shield as well as the debris accumulated thereon, can cause the gutter or the shield to collapse and/or pull away from the fascia to which it is attached. Thus, the shield may create more problems than it solves. There is therefore a need for a gutter shield that is effective in preventing the accumulation of debris both in and on top of a gutter, and that allows the debris to fall away or be swept off of the shield by wind and rain.

The prior art contains a number of gutter shields that are sloped downward and outward and which have apertures through the downslope for separating water from debris. The optimum shape of the shield material around and leading into each aperture, and therefore the size, shape and location of an aperture, is the subject of much debate and is often a factor in distinguishing one shield from another. These shapes, etc. affect the water's flow rate, capillary action and sheeting, as well as the size/shape of debris that is filtered out and whether the debris will accumulate on the shield and/or clog its apertures.

Capillary action and sheeting are both effects of surface tension but may effectively work against each other. For example, capillary action results in water being "held" against a surface and "pulled" through an aperture toward which and/or through which the surface leads the water. In opposition to this, water may pass over an aperture if the water is held together by surface tension in a continuous "sheet". Such a sheet must be effectively broken or perforated in order for any of the water to drain away into an aperture below the sheet. It is also possible for a sheet of water to form on the underside of a sloped surface, thereby forming a barrier to water flow down through the sheet from apertures above it.

U.S. Pat. No. 4,418,504 (Lassiter; 1983) discloses a sloped shield having apertures (19) that are positioned between an upstream arch followed by a trough. U.S. Pat. No. 6,016,631 (Lowrie, III; 2000) discloses a gutter device having a plurality of holes (31), preferably formed by creating a depression (31) in the downslope portion. U.S. Pat. No. 5,271,191 (Vahamaki; 1993) discloses a gutter shield having slotted (24) vanes (26) wherein the vanes are sloped downward at a vane angle (27) relative to the plane of the shield's stock material. U.S. Pat. No. 6,151,837 (Ealer, Sr.; 2000) discloses a perforated sheet gutter screen comprising a sheet metal member with a generally smooth top surface and a plurality of channels (54) and slots (56), wherein each channel extends downward and away from the top surface and has a lower end that defines a lower portion of the periphery of one of the slots, and has a concave profile such that an upper, leading edge of the channel is curved substantially along its full length.

In light of the abovedescribed problems and defects in the prior art, it is an object of the present invention to overcome these defects by providing a gutter shield that not only separates even small debris from rainwater, but furthermore resists accumulation of the debris on the gutter shield, and even further encourages the flow of water through the shield and into the shielded gutter even when water is flowing rapidly and tending to "sheet" above and/or below the shield.

BRIEF SUMMARY OF THE INVENTION

According to the invention a gutter shield is disclosed for separating debris from water entering a gutter, the shield being intended for installation over a conventional longitudinally extending gutter that is mounted outboard from and below a longitudinally extending roof edge, the gutter shield comprising: a longitudinally extending length of planar stock material that is perforated by a plurality of intermittent, longitudinally extending slots, each slot being at the outboard edge of a tab that ramps downward and outward from a top surface of the stock material; and a longitudinally extending ridge extending downward from an underside of the shield for the purpose of breaking up water sheeting along the underside of the shield.

According to the invention, the gutter shield is characterized in that the ridge extends downward at a sharp angle from the underside of the shield between laterally adjacent tabs.

According to the invention, the gutter shield is characterized in that the ridge is an elongated outboard end of a tab such that the tab end is extended outward past the slot associated with the tab.

According to the invention, the gutter shield is characterized in that the elongated outboard end of the tab extends outward and downward in the same plane as the part of the tab that passes under an outboard slot edge. Alternatively, the elongated outboard end of the tab curls outward and downward with the tightest curvature being after the tab passes under an outboard slot edge. Preferably the tab has an elliptical profile starting with a gradual, smoothly curving bend shape at an inboard tab bent edge.

According to the invention, the gutter shield is characterized in that the ridge extends downward at a sharp angle from the underside of a tab portion of the shield.

According to the invention, the gutter shield further comprises a gradual, smoothly curving bend shape at an inboard bent edge of the tab.

According to the invention, the gutter shield further comprises a shallow angle of approximately 15 to 45 degrees between a planar portion of the tab and the shield surface.

According to the invention, the gutter shield further comprises a fastening flange that is at an outboard lateral edge of the gutter shield and is offset slightly upward from the plane of the gutter shield, for fastening the gutter shield to the gutter with the majority of the outboard lateral edge being underneath a gutter marginal edge.

According to the invention, the gutter shield is characterized in that the ridge is a fold in the stock material.

According to the invention, a method is disclosed for encouraging water to flow rapidly into a conventional gutter that is covered by a gutter shield for separating debris from the water, wherein the gutter shield comprises a longitudinally extending length of planar stock material, and the method comprises the steps of: perforating the stock material with a plurality of intermittent, longitudinally extending slots, each slot being at the outboard edge of a tab that ramps downward and outward from a top surface of the stock material; and breaking up water sheeting along the underside of the shield by providing a longitudinally extending ridge that extends downward from an underside of the shield.

According to the invention, the method further comprises the step of extending the ridge downward at a sharp angle from the underside of the shield between laterally adjacent tabs.

According to the invention, the method further comprises the step of providing the ridge on a tab by elongating an outboard end of the tab such that the tab end is extended outward past the slot associated with the tab. A further step comprises using the ridge to also entrain water flowing off the end of the tab by extending the tab outward and downward in the same plane as the part of the tab that passes under an outboard slot edge. Alternatively, a further step comprises using the ridge to also entrain water flowing off the end of the tab by curling the tab outward and downward with the tightest curvature being after the tab passes under an outboard slot edge. An additional step comprises curling the tab along an elliptical profile starting with a gradual, smoothly curving bend shape at an inboard tab bent edge.

According to the invention, the method further comprises the step of encouraging capillary action in opposition to water sheeting on the top surface by gradually and smoothly curving the bend at an inboard bent edge of the tab.

According to the invention, the method further comprises the step of providing a shallow angle of approximately 15 to 45 degrees between a planar portion of the tab and the shield surface.

According to the invention, the method further comprises the step of fastening the gutter shield to the gutter such that the majority of the outboard lateral edge lies underneath a gutter marginal edge.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar or related but modified elements may be referred to with similar numbers in a single drawing. For example, each of a plurality of related elements collectively referred to as 199 may be referred to individually as 199*a*, 199*b*, 199*c*, etc. Or, elements may have the same number but are distinguished by primes. Such relationships, if any, between similar elements in the same or different figures will become apparent throughout the specification, including, if applicable, in the claims and abstract.

Figure 1:
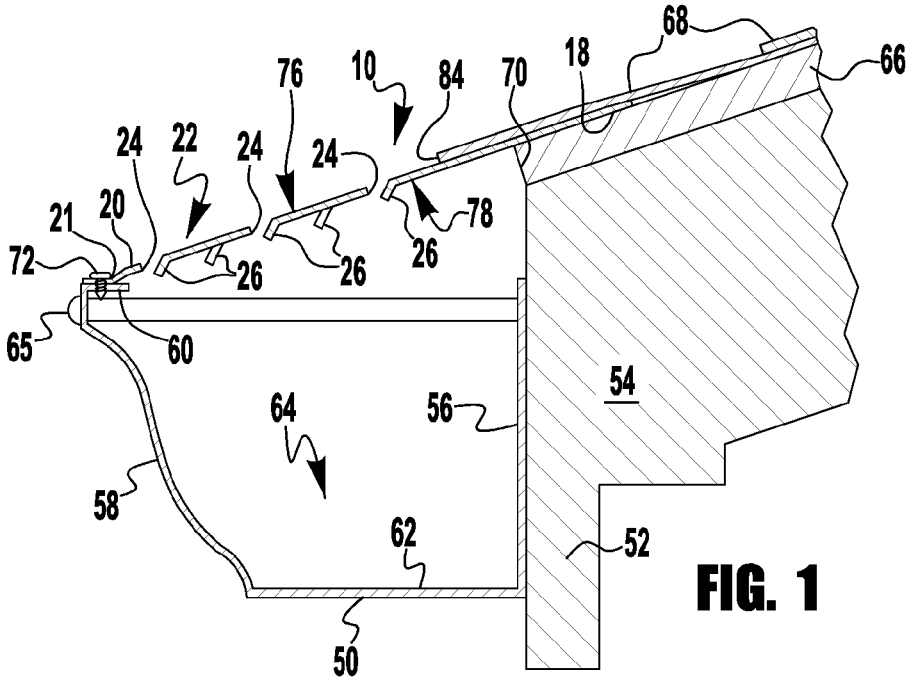
Figure 2A:
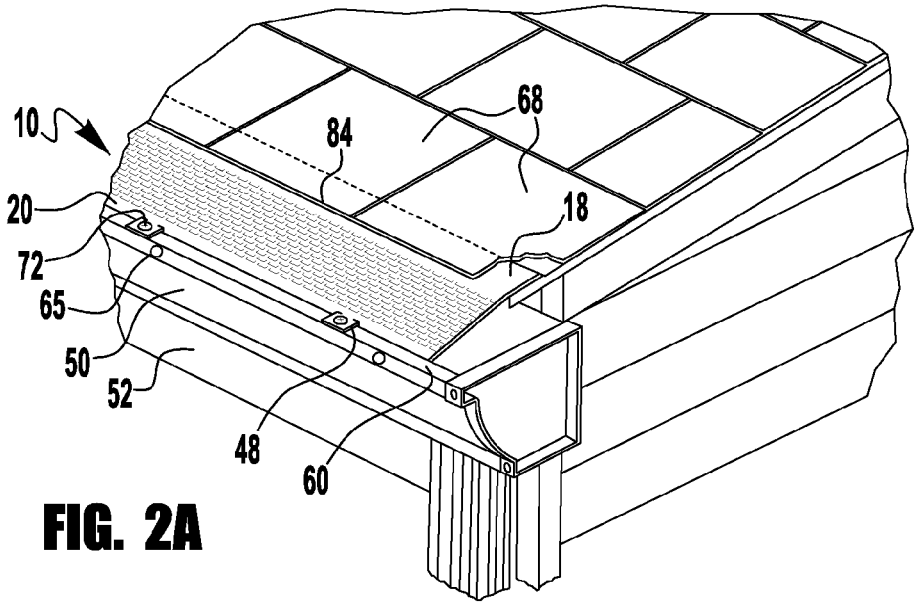
Figure 2B:
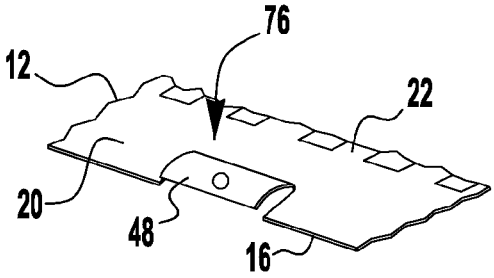
Figure 3:
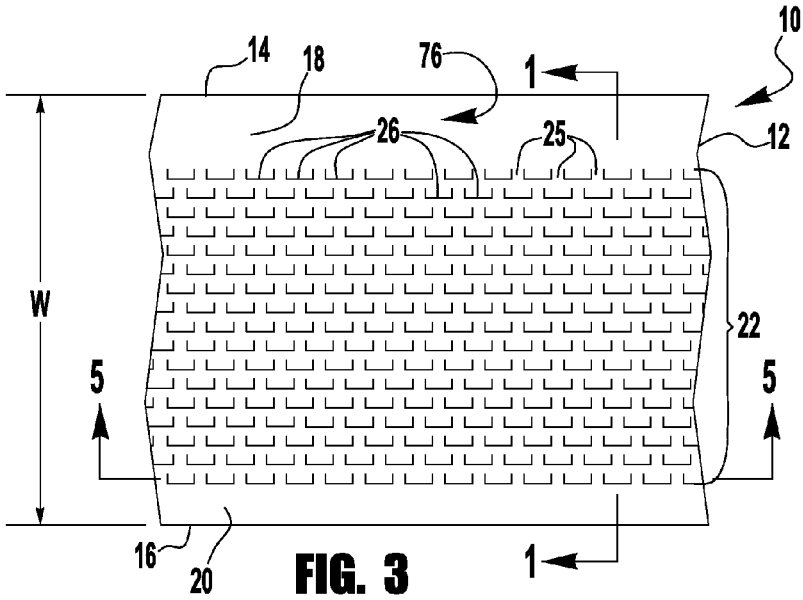
Figure 4:
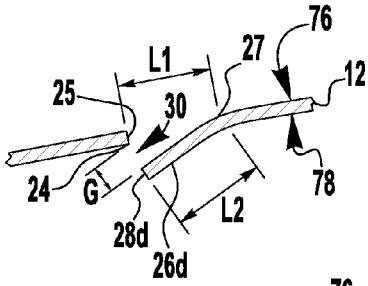
Figure 5A:
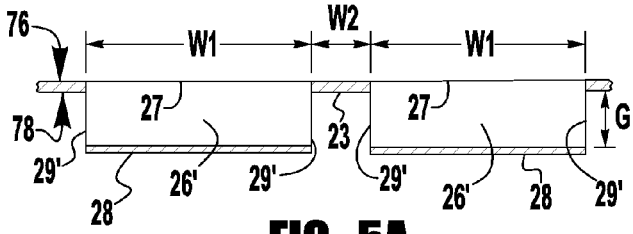
Figure 5B:
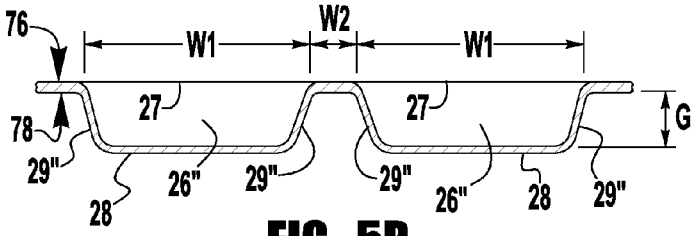
Figure 6A:
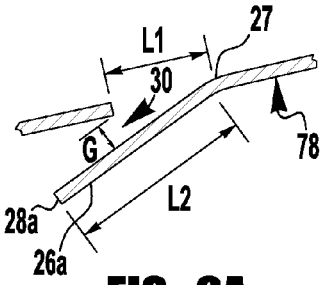
Figure 6B:
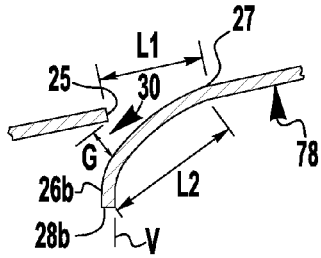
Figure 6C:
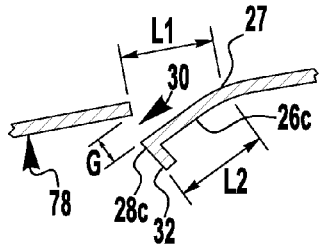
Figure 7:
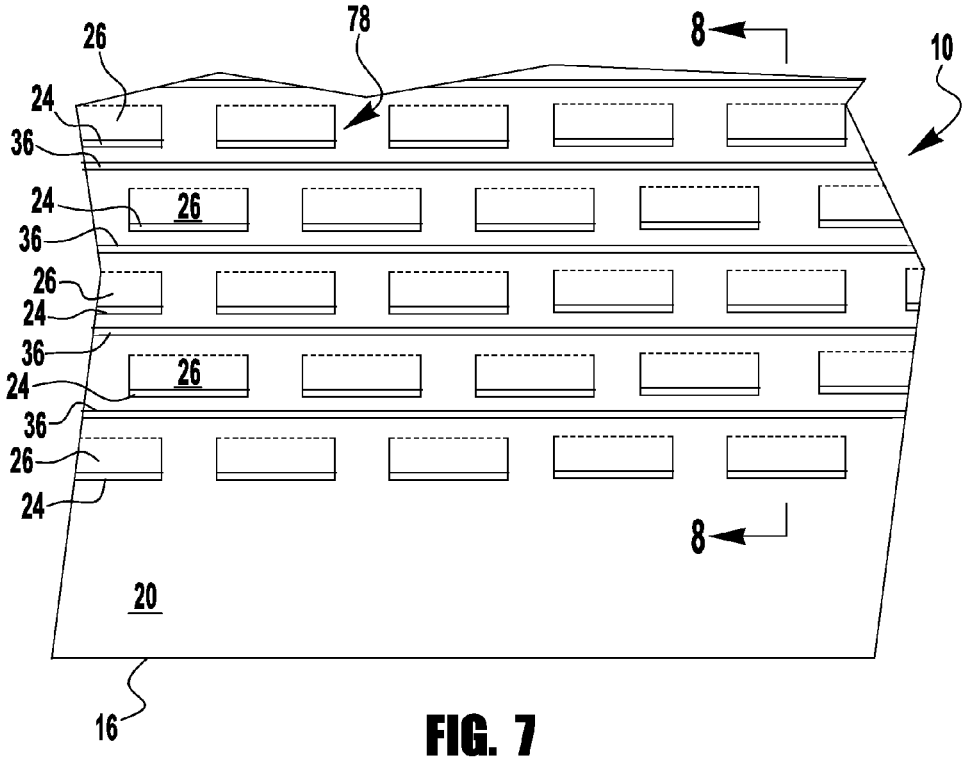
Figure 8:
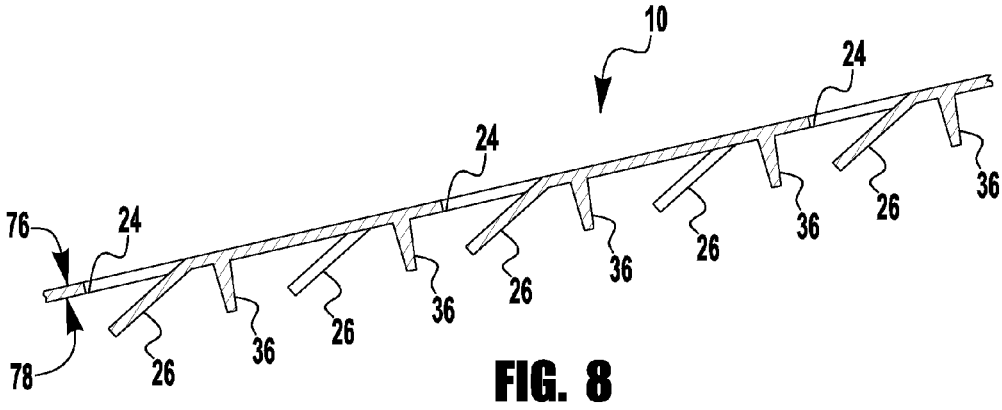

The structure, operation, and advantages of the present preferred embodiment of the invention will become further apparent upon consideration of the following description taken in conjunction with the accompanying drawings, wherein:

FIG. 1 is a side cross-sectional view of a gutter shield installed on a conventional gutter and roof structure, the view of the shield being taken along the line 1-1 shown in FIG. 3, all according to the invention;

FIG. 2A is a perspective view of a gutter shield embodiment with fastening flanges used to install the shield on the conventional gutter and roof structure, according to the invention;

FIG. 2B is a perspective view of a portion of the gutter shield embodiment with fastening flanges of FIG. 2A, according to the invention;

FIG. 3 is a top view of a gutter shield, according to the invention;

FIG. 4 is a side cross-sectional view of a tab and slot portion of the gutter shield of FIG. 3, the view being taken along the line 1-1 shown in FIG. 3, wherein the tab is a basic tab embodiment, according to the invention;

FIGS. 5A and 5B are edge cross-sectional views of tab and slot portions of a gutter shield, the view being taken along the line 5-5 shown in FIG. 3, wherein alternative embodiments of the tab (cut tab in 5A and formed tab in 5B) are illustrated, according to the invention;

FIGS. 6A, 6B, and 6C are side cross-sectional views of a tab and slot portion of the gutter shield of FIG. 3, the view being taken along the line 1-1 shown in FIG. 3, illustrating three alternative tab embodiments (elongated), according to the invention;

FIG. 7 is a bottom view of a portion of a gutter shield that has longitudinal ridge-walls, according to the invention; and FIG. 8 is a side cross-sectional view of a portion of the gutter shield of FIG. 7, the view being taken along the line 8-8 shown in FIG. 7, according to the invention.

DETAILED DESCRIPTION OF THE INVENTION

Referring to FIGS. 1-5, in accordance with the present invention, there is provided a gutter shield 10 formed of a longitudinally extending length of planar stock material 12 (e.g., sheet aluminum, e.g., plastic material) having parallel inboard and outboard longitudinally extending lateral edges 14 and 16, respectively, separated by a distance W representing the width of the gutter shield 10 and, in most cases, also the width of the planar stock material 12. The gutter shield 10 further comprises a relatively wide inboard marginal area 18 and a relatively narrow outboard marginal area 20. An intermediate perforated portion 22 is disposed between the respective inboard and outboard marginal areas 18 and 20. The perforated portion 22 is formed with a plurality of intermittent open slots 24 arranged in parallel longitudinally extending rows. Each slot 24 is an aperture (hole, perforation through the shield 10) at the outboard edge of a tab 26 (also indicated in these figures as tab embodiments 26*d*, 26', 26") that is formed by down-ramping a portion of the stock material 12 immediately inboard from the slot 24. Thus the tab 26 forms a downward and outward sloping ramp as an inlet 30 for the slot 24, wherein the inlet 30 directs water into the slot 24 which has a sufficiently deep gap G (e.g., 0.06") to allow rain water therethrough, but is small enough to block seeds and small debris fragments from passing through or catching and clogging therein. The outboard edge 25 of the slot 24 (see detail in FIG. 4) is illustrated as a blunt squared off edge, but especially for thicker gauge stock material 12 it is advantageous to cut the edge 25 at a bias such that it functions as a sharp knife edge for cutting apart a large item of debris that might otherwise simply get stuck in the slot 24 and clog it.

FIGS. 1 and 2A illustrate the gutter shield 10 installed over a gutter 50 which is secured to the fascia board 52 of a pitched roof structure 54. It should be understood that the invention may be employed with a variety of roof structures. The pitched roof structure 54 illustrated is simply a convenient expedient for describing the invention and is a preferred application.

The gutter 50 is typically formed from a sheet of stock material having an upstanding inboard wall 56 which abuts the fascia 52 and an outboard upstanding wall 58 having a formed upper marginal edge 60 which turns inwardly of the gutter 50. A bottom wall portion 62 interconnects the respective inboard and outboard upstanding walls 56 and 58 to form an open trough portion 64. The gutter 50 may be secured to the fascia boards 52 by any conventional means including brackets (not shown) or long ferrule nails 65.

The conventional pitched roof structure 54 has a sheathing portion 66 which extends to the roof edge 70. The sheathing 66 is covered with overlapping rows of shingles 68. The roof edge 70 generally extends up to the fascia board 52, as illustrated. The gutter shield 10 is shown installed over the gutter 50. The inboard marginal area 18 is inserted between the sheathing 66 and the outermost/uppermost row of the shingles 68 and is optionally sealed and/or secured there by, for example roofing cement and/or nails. Generally there are at least two layers of shingles at the roof edge 70, with a "starter row" being laid on the sheathing 66 underneath the outermost row of the shingles 68. In addition, there may be a second or even a third layer of shingles 68 on the roof sheathing 66, newer layers having been added to cover older layers of worn-out shingles 68. At any rate, the inboard marginal area 18 of the gutter shield 10 can be inserted anywhere in the stack of shingles 68 as long as it at least lies underneath the uppermost layer of the outermost row of the shingles 68. The outboard marginal area 20 is secured to the upper marginal edge 60 of the gutter 50 by conventional means such as, for example, self-tapping screws 72.

In a preferred embodiment, the gutter shield 10 lies along and is generally aligned with the pitch of the roof structure 54, and the shingles 68 are disposed over the inboard marginal area 18. The perforated portion 22 is preferably located outboard of an outermost edge 84 of the shingles 68 and above the open trough 64 of the gutter 50 for directing rainwater and the like therein. In order to maintain a planar, downward and outward sloped perforated portion 22, the gutter shield 10 can be bent at a suitable angle as needed longitudinally along the inboard marginal area 18 and/or along the outboard marginal areas 20. FIG. 1 shows such a longitudinal bend 21 in the outboard marginal area 20.

FIGS. 1 and 2A illustrate two alternative modes of attaching (securing) the gutter shield 10 to the gutter 50. In FIG. 1, the entire outboard marginal area 20 lies on top of the gutter upper marginal edge 60, thus causing debris and any water that does not pass through the slots 24 to flow over or out beyond the outboard gutter wall 58. Referring to FIGS. 2A and 2B, most of the length of the outboard marginal area 20 lies below the gutter upper marginal edge 60 (e.g., trapped between the edge 60 and the ferrule nails 65), thus allowing water that does not pass through the slots 24 to flow between the marginal area 20 and the gutter marginal edge 60 and thereby into the gutter trough 64. The majority of debris should still be pushed out beyond the outboard gutter wall 58. Positioning and attachment of the gutter shield 10 is enabled by suitably spaced apart fastening flanges 48 that can be simply formed by cutting a pair of lateral slits in from the outboard lateral edge 16 and then bending the stock material 12 to offset it slightly upward between the paired slits. Each of these two attachment modes has its own advantages as described, and therefore they are alternative preferred embodiments, both of which are intended to be within the scope of the present invention.

It can be seen that the gutter shield 10 has a top (upper) surface 76 and an under side (lower or bottom surface) 78, and the tabs 26 ramp down away from the lower surface 78 as illustrated. Thus, any accumulated debris on the upper surface 76 tends to be washed toward the outboard edge 16 by rainwater and the like as it runs off the roof. Momentum and wind will then carry the debris off of the gutter shield 10. At the same time, it can be seen that the tabs 26 are formed such that the slots 24 are sufficiently wide so that rainwater running down along the top surface 76 of the shield 10 will pass through the slots 24 to enter the open trough 64 as directed by the tabs 26.

The inboard marginal area 18 of the shield 10 protects the roof sheathing 66 near the roof edge 70 and acts like a starting course for the shingles 68. It can be seen that the inboard marginal area 18 covers the roof sheathing 66 and protects it from water seepage. Also, the lie of the gutter shield 10 along the pitch of the roof helps to deflect water away from the roof sheathing 66 such that instead of dripping off the outermost edge 84 of the shingles 68, the water will instead travel downward/outward along the gutter shield 10 and through the slots 24 into the gutter 50.

In the embodiment illustrated in FIGS. 1-5, for a typical gutter system, the gutter shield 10 has an overall width W of about 6 inches and is made using a nominal 0.027 inch thick stock material 12. The inboard marginal area 18 is about 2 inches wide; the outboard marginal area 20 is about ½ inch wide; and the perforated portion 22 is about 3½ inches wide, all measured laterally. In the embodiment illustrated, the slots 24 have a first dimension W1 of about 7/16 inches and are spaced apart by spaces 23 having a second, smaller dimension W2 of about ⅜ inches. The slots 24 provide a gap G of about 0.026 inches for water to pass through, the gap G dimension being determined by the positioning of the tab 26 as it ramps downward.

The slots 24 extend longitudinally and are preferably aligned in regularly laterally spaced rows, with the slots 24 (and associated tabs 26) in each row being staggered relative to the slots/tabs 24/26 in adjacent rows such that a slot 24 is outward of, and overlapping, the space 23 between two slots/tabs 24/26 in the inward adjacent row. In this way, water that flows over the space 23 in one row will be directed into a slot/tab 24/26 immediately afterward in the next row.

Since the tab 26 is sloped downward and outward toward the associated slot 24, the tab 26 channels water flowing over the top surface 76, thereby directing the water toward and through the slot 24. The shape and relative dimensions of the slot 24 and tab 26 have important effects on the flowing water, especially in terms of encouraging capillary flow through the slot 24 while also breaking up sheeting of the water on the top surface 76 (which holds back flow down to the slot 24), and also breaking up sheeting of the water along the bottom surface 78 (which obstructs flow through the slot 24 and down into the gutter trough 64).

Referring particularly to FIGS. 4-8, important features of the inventive gutter shield 10 will be disclosed in several embodiments. FIGS. 4, 5A and 5B show side and front cross-sectional views of two alternate embodiments (26', 26") of a basic tab 26*d* according to the invention. FIGS. 6A, 6B, and 6C show side cross-sectional views of three enhanced embodiments (26*a*, 26*b*, 26*c*) of a tab 26 according to the invention. The reference number 26 is used herein to collectively refer to all embodiments (e.g., 26', 26", 26*a*, 26*b*, 26*c*, 26*d*) of the inventive tab 26.

In its simplest form, the basic tab 26*d* can be formed by: longitudinally slitting the stock material 12 (e.g., aluminum sheet metal) to form a slot 24 that is the dimension W1 in length and is bounded by an outboard slot edge 25 and an outboard tab edge 28*d*; by either cutting (cut tab 26') or stretch forming (formed tab 26") a pair of tab sides 29', 29" of length L1; and by bending the tab 26 downward at an uncut inboard tab edge 27 that is parallel to the outboard slot edge 25. When formed this way, the basic tab 26*d* will have a tab length L2 that is equal to the tab side lengths L1, and the slot 24 that forms the hole through which water can pass will have a slot gap dimension G that is determined by the perpendicular distance between the bottom of the outboard slot edge 25 and the nearest portion of the tab 26 (which for this basic tab 26*d* is the top of the outboard tab edge 28*d*). Since the size of the hole available for water passage is also affected by the tab sides 29', 29", the cut tab 26' is preferred over the formed tab 26"; and for a formed tab 26" the formed sides 29" are preferably as vertical as possible, thereby maximizing the width of the outboard tab edge 28 that is longitudinally straight and at the gap distance G (different embodiments of the outboard tab edge labeled 28*a*, 28*b*, 28*c*, 28*d* are generically and collectively referred to as outboard tab edge 28).

Thus the dimensions of the slot 24 in terms of gap G and width W1 determine a hole size, or aperture dimension that will have a first order effect on the maximum flow rate (throughput) of water through the inlet 30. For a given set of G and W1 dimensions, the effective aperture can be increased by using a cut tab 26' that has open tab sides 29'. The effective aperture can be further increased if the open tab sides 29' are bent (e.g., curled) downward away from the sides of the hole in the stock material 12 (thereby also imparting a downward curve to the outboard tab edge 28. Alternatively, the open tab sides 29' and/or the outboard tab edge 28 can be cut away to form a trapezoidal tab 26 (not illustrated) with a smaller surface area than the hole in the stock material 12.

Sheeting and capillary action are secondary effects on flow rate/throughput, but they can still have significant impact, and are important considerations in the present invention. In particular, effective aperture size of the slots 24 (inlets 30) can only be increased so far before the shield's separation or straining effectiveness is reduced to the point that undesirable amounts and sizes of debris are able to pass through into the gutter 50 or only partially through to become stuck and plugging the slot 24 as well as to cause accumulation of debris on the shield 10. Sheeting on the shield top surface 76 is broken up (perforated) by maximizing the size (L1 by W1) of the inlet hole 30 (thereby maximizing the weight of the water that is trying to fall through), and by minimizing the space 23 between holes, i.e., making dimension W2 as much smaller than W1 as possible while limited by a suitable bending strength for the perforated portion 22 of the shield 10. Perforation of the water sheet on top may also be helped by having the sharp edges that result from forming a cut tab 26'.

Capillary action is enhanced by forming the bend at the inboard tab edge 27 as a gradual, smoothly curving bend, i.e., a bend with a large radius of curvature. As shown in FIGS. 4, 6A and 6C, the tab 26 straightens out after the bend 27 to ramp downward and outward at a shallow angle relative to the shield surface 78, for example approximately 15 to 45 degrees, preferably about 30 degrees. As shown in FIG. 6B, the tab 26*b* has a curved cross-sectional shape (e.g., elliptical) that continues the gradual, smoothly curving bend shape all the way from the inboard tab edge 27 to the outboard tab edge

28*b*. The gradual, smoothly curving bend enables water surface tension and capillary action to hold the water against the down-ramping tab 26 in opposition to the lifting force of surface tension that is trying to hold the water sheet together above the inlet 30.

FIGS. 6A, 6B and 6C illustrate three exemplary alternate tab embodiments 26*a*, 26*b* and 26*c*, respectively, that are designed to prevent, break up, or at least to minimize water sheeting along the underside 78 of the shield 10. The illustrated alternate embodiments are examples of tabs 26 that are elongated such that the outboard tab edge 28 extends farther downward from the underside 78 than the basic tab 26*d*, while still maintaining the same gap G dimension (and therefore the same debris straining aperture characteristics). By extending further downward, the elongated tab 26*a*, 26*b*, 26*c* will push any water that is sheeting on the underside 78 further away from the underside 78, and therefore the elongated tab 26*a*, 26*b*, 26*c* will be more likely to break up such a sheet, detaching it from the underside 78 and causing it to fall down into the gutter trough 64 below. Importantly, such water sheet breaking will also prevent blockage of water flowing through the inlet 30 and off the end 28 of the tab 26. In fact, water that is not sheeting across the slot 24 but is flowing downward and outward along the underside of the tab 26 and off of the tab end 28 may actually enhance inlet 30 throughput by entraining water that is flowing downward and outward on the top of the tab 26 and off of the tab end 28. It should be apparent that elongated tabs 26*a*, 26*b*, 26*c* such as these, wherein the elongated tab 26*a*, 26*b*, 26*c* has a tab length L2 that is greater than the inlet hole length L1, will be most easily made as a part (e.g., plastic) that is either molded, or extruded and post-formed.

By way of example: a straight elongated tab 26*a* uses it's extra length L2 to place the tab end 28*a* farther away from the underside 78 of the shield, but has a substantially straight profile to maximize the entraining effect. Alternatively, a curved elongated tab 26*b* has an elliptical profile with the tightest curvature being after the tab 26*a* passes under the outboard slot edge 25 to establish the desired gap G dimension, thereby not only further lowering the tab end 28*b* but also curling the tab end 28*b* into a vertical (V) lip that still enables some degree of entraining because of the curved tab underside. Alternatively, a ridged elongated tab 26*c* has a breakwall ridge 32 extending downward at a sharp angle (e.g., 90°) at the tab end 28*c*. The breakwall ridge 32 is most effective in breaking apart a water sheet, but least effective in entraining.

FIGS. 7 and 8 illustrate another way to provide a breakwall underneath the gutter shield 10. Between adjacent rows of tabs 26 and slots 24, a longitudinally extending ridge-wall 36 extends downward at a sharp angle (e.g., 90 degrees) from the underside 78 of the shield 10. It is within the scope of this invention for a ridge-wall 36 to be non-linear and/or intermittent, although the continuous longitudinally linear form illustrated is the preferred embodiment. For example, the ridge-wall 36 could advantageously be zig-zagged and/or could incorporate lateral ribs, either of which would add to the lateral bending strength of the gutter shield 10. An advantage of the shield embodiment illustrated in FIGS. 7 and 8 is that in addition to being moldable or extrudable, it can also be continuously formed out of sheet metal using rolling ridge-formers to form folded ridges followed by rolling die/punches to form the tabs and slots.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

What is claimed is:

1. A shield installed for separating debris from water that is flowing downward and outward on a pitched roof, the roof having a pitch angle that is acute relative to horizontal, and the shield being installed by attachment to the roof; the installed shield comprising:

a substantially planar perforated portion is at an acute angle that is approximately aligned with the roof pitch angle such that the substantially planar perforated portion has a top surface facing generally upward and a bottom surface facing generally downward;

perforations comprising a plurality of intermittent, longitudinally extending slot openings through the top surface, wherein the longitudinal direction is defined as being substantially horizontal and orthogonal to the pitch angle of the roof;

a tab that ramps from the top surface downward and outward through the slot opening; and a longitudinal breakwall comprising a wall extending downward from the tab at an angle approximately ninety degrees relative to an underside of the tab.

2. The installed shield of claim 1, further comprising: a plurality of the tabs such that one of the tabs is associated with each one of the slot openings.

3. The installed shield of claim 1, further comprising: a gradual, smoothly curving bend shape of the tab where it extends from the top surface of the shield.

4. The installed shield of claim 1, further comprising: a substantially planar portion of the tab from the bend to where it passes under the outward edge of the slot opening.

5. The installed shield perforated portion of claim 4, further comprising: a shallow angle of approximately 15 to 45 degrees between the substantially planar portion of the tab and the top surface of the substantially planar perforated portion of the shield; and a slot gap dimension, measured between the outward edge of the slot opening and the nearest part of the associated tab, in a range from about 0.026 inches to about 0.060 inches.

6. The installed shield of claim 1, wherein: the outward end of the tab curls outward and downward, such that a tightest curvature of the curl is after the tab passes under an outward edge of the slot opening.

7. The installed shield perforated portion of claim 6, wherein: the tab has an elliptical profile starting with a gradual, smoothly curving bend shape of the tab where it extends from the top surface of the shield.

8. A method for encouraging water flowing downward and outward on a pitched roof, to flow rapidly through a substantially planar perforated portion of a shield that is attached to the roof for separating debris from the water; the roof having a pitch angle that is acute relative to horizontal, and the shield being a sheet of stock material that is adapted for attachment to the roof, wherein descriptive directions for the shield are determined according to directions relative to the roof when the shield is attached thereto as adapted therefor; the method comprising the steps of: attaching the shield to the roof such that the substantially planar perforated portion is at an acute angle that is approximately aligned with the roof pitch angle; providing water passage through a top surface of the shield by forming perforations of the perforated portion that comprise a plurality of intermittent, longitudinally extending slot openings; breaking surface tension to draw water through the shield by providing a tab that ramps from the top surface of the shield downward and outward through the slot opening; and breaking up water sheeting along an underside of the shield by providing a longitudinal breakwall that extends downward from the tab at an angle of approximately ninety degrees relative to an underside of the tab, thereby forming a barrier to the flow of water that otherwise would tend to sheet on the underside of the shield.

9. The method of claim 8, further comprising the step of: curling the tab along an elliptical profile starting with a gradual, smoothly curving shape at a bend where the tab bends to ramp downward and outward from the top surface of the shield.

10. The method of claim 8, further comprising the step of: encouraging capillary action in opposition to water sheeting on the top surface of the shield by gradually and smoothly curving the tab where it bends to ramp downward and outward from the top surface of the shield.

11. The method of claim 10, further comprising the step of: providing a substantially planar portion of the tab from the bend to where it passes under the outward edge of the slot opening.

12. The method of claim 11, further comprising the step of: forming the bend such that the substantially planar portion of the tab is at a shallow angle of approximately 15 to 45 degrees relative to the top surface of the substantially planar perforated portion of the shield.

13. The method of claim 8, further comprising the step of: extending the breakwall downward at an angle of approximately ninety degrees relative to the top surface of the substantially planar perforated portion of the shield.

14. The method of claim 8, further comprising the step of: maximizing water flow through the slot openings while minimizing clogging by debris, by limiting a slot gap dimension, measured between the outward edge of the slot opening and the nearest part of the associated tab, to a range from about 0.026 inches to about 0.060 inches.

* * * * *